US005452811A

United States Patent [19]

Taravella et al.

[11] Patent Number: 5,452,811

[45] Date of Patent: Sep. 26, 1995

[54] STACKABLE PARTITIONED SHIPPING CONTAINER

[75] Inventors: Philip Taravella, Grosse Pointe Shores; Edward J. Blair, New Baltimore; Ronald S. Domanski, St. Clair Shores; Joseph C. Shippell, Roseville, all of Mich.

[73] Assignee: Anchor Bay Packaging Corporation, St. Clair Shores, Mich.

[21] Appl. No.: 180,734

[22] Filed: Jan. 13, 1994

[51] Int. Cl.[6] ..... A47F 5/00

[52] U.S. Cl. ..... 211/186; 211/188; 211/10; 211/194

[58] Field of Search ..... 211/186, 188, 211/135, 194, 10; 108/60, 111

[56] References Cited

U.S. PATENT DOCUMENTS

| | | | |
|---|---|---|---|
| 914,685 | 3/1909 | Waters | 108/60 |
| 937,659 | 10/1919 | Todd | 211/135 X |
| 971,707 | 10/1919 | Waters | 108/60 |
| 2,797,819 | 7/1957 | Lowmaster | 211/135 |
| 3,172,376 | 3/1965 | Havlis | 211/186 X |
| 3,856,147 | 12/1974 | Piretti | 211/188 |
| 4,062,302 | 12/1977 | Krizan | 211/135 X |

FOREIGN PATENT DOCUMENTS

| | | | |
|---|---|---|---|
| 561109 | 2/1931 | Germany | 211/135 |

*Primary Examiner*—Robert W. Gibson, Jr.
*Attorney, Agent, or Firm*—Dykema Gossett

[57] ABSTRACT

A stackable partitioned shipping container has a plurality of partitions and shelves defining compartments. The partitions are aligned parallel from one side of the shipping container to the other. The shelving is arranged in columns between the partitions. Rods are strung through the partitions to support the shelves. The frames have hollow tubular columns at each corner thereof. At the top of the columns are inserts which are insertable into the hollow columns of another shipping container stacked upon the first shipping container. Wheels that support the shipping container are supported above the top of a bottom container when the container is stacked upon the bottom container.

8 Claims, 3 Drawing Sheets

STACKABLE PARTITIONED SHIPPING CONTAINER

FIELD OF THE INVENTION

The present invention relates to stackable shipping containers or more particularly to stackable shipping containers having partitioned shelving. Still more particularly, the present invention relates to a stackable partitioned shipping container that has reinforced internal shelving forming compartments.

OBJECTS OF THE INVENTION

The purpose and object of this invention is to provide an improved construction for a stackable shipping container having compartments for receiving articles to be shipped therein or moved about a warehouse.

Another object of the present invention is to provide a stackable shipping container that may be rolled about a warehouse floor and lifted by forklift to be stacked on other stackable shipping containers.

Yet another object of the present invention is to provide a stackable shipping container having shelving that is reinforced to receive heavy loads thereon.

Yet still another object of the present invention is to provide a stackable shipping container having reinforced shelving and being interlockingly stackable with other stacking containers.

SUMMARY OF THE INVENTION

The foregoing objects are accomplished by the present invention in which a stackable partitioned shipping container has a frame comprising front posts, rear posts, runners, front stringers, rear stringers, cross bracing, a slat stringer, and slats. Wheels support the frame above the floor. The floor of the frame is a panel of generally of the same type as panel partitions that separate the stackable shipping container into columns of compartments.

The panel partitions that separate the columns of compartments include end panel partitions and a rear panel partition. All of the panel partitions are plastic sheets. After the floor is laid in the frame, and the rear panel partition placed in the frame against the rear posts and cross bracing at the rear of the frame, the panel partitions are placed within the frame starting with an end panel partition at a first side and the other panel partitions are positioned one at a time toward an opposite second side. The first panel partition is anchored to a front post and a rear post on the first side of the frame. The other panel partitions are positioned and held in place by channel shelves which are positioned within the frame on a column by column basis.

Each panel partition has a multiplicity of determinately spaced holes. Each channel shelf has channel legs that are provided with holes spaced determinately along the channel legs, at generally the spacing from front to rear of the spaced holes in the panel partitions. In an alternative embodiment, the channel shelves are constructed of corrugated sheets with passageways provided by the corrugations. As a channel shelf is placed into position beside a standing panel partition, the holes of the channel shelf are roughly aligned with the spaced holes of the panel partition. A rod is strung through a hole of the panel partition and the aligned holes of the two channel legs of the channel shelf. Each remaining set of aligned holes of the channel legs adjacent the panel partition is also strung with a rod which is first strung through an aligned hole of the panel partition. In the alternative, corrugated embodiment of the shelf, the rods are strung through the passageways provided by the corrugations. Each channel shelf necessary to complete a column of channel shelves above or below the channel shelf is spaced one above or below another, each having its holes strung with rods extending through the panel partition. Thereafter, another panel partition is placed on the floor of the frame with its holes aligned with the rods extending from the channel legs of the channel shelves in the column with the channel shelf. This is repeated again and again with additional panel partitions until all of the panel partitions and channel shelves are in place. Preferably, an end panel partition is last placed on the frame at the second side, which is fastened to the frame. Protruding from the last end panel are ends of the rods, each of which is capped with a cap. A like cap is provided on the end of each rod protruding from the first end panel partition. An end channel is used to dress the front edge of each panel partitions.

An insert at the top of each front post and rear post may be received in a hollow of a front post or rear post when one stackable partitioned shipping container is stacked upon another stackable partitioned shipping container. The sum of the lengths of the top of the front post or rear post (from an end of the post, to the front stringer or rear stringer most proximate to the end of the post) and the length of the bottom of the front post or rear post (from an end of the post, to the front stringer or rear stringer most proximate to the end of the post) is greater than the diametric length from the periphery of each wheel to the plate on which the wheel is mounted. Accordingly, when one stackable partitioned shipping container is stacked upon another stackable partitioned shipping container, the wheels are suspended between stackable partitioned shipping containers.

BRIEF DESCRIPTION OF THE DRAWINGS

Other objects and features of the invention will become apparent by reference to the following specification and to the drawings, in which.

DETAILED DESCRIPTION OF THE PREFERRED EMBODIMENT

Figure 1:
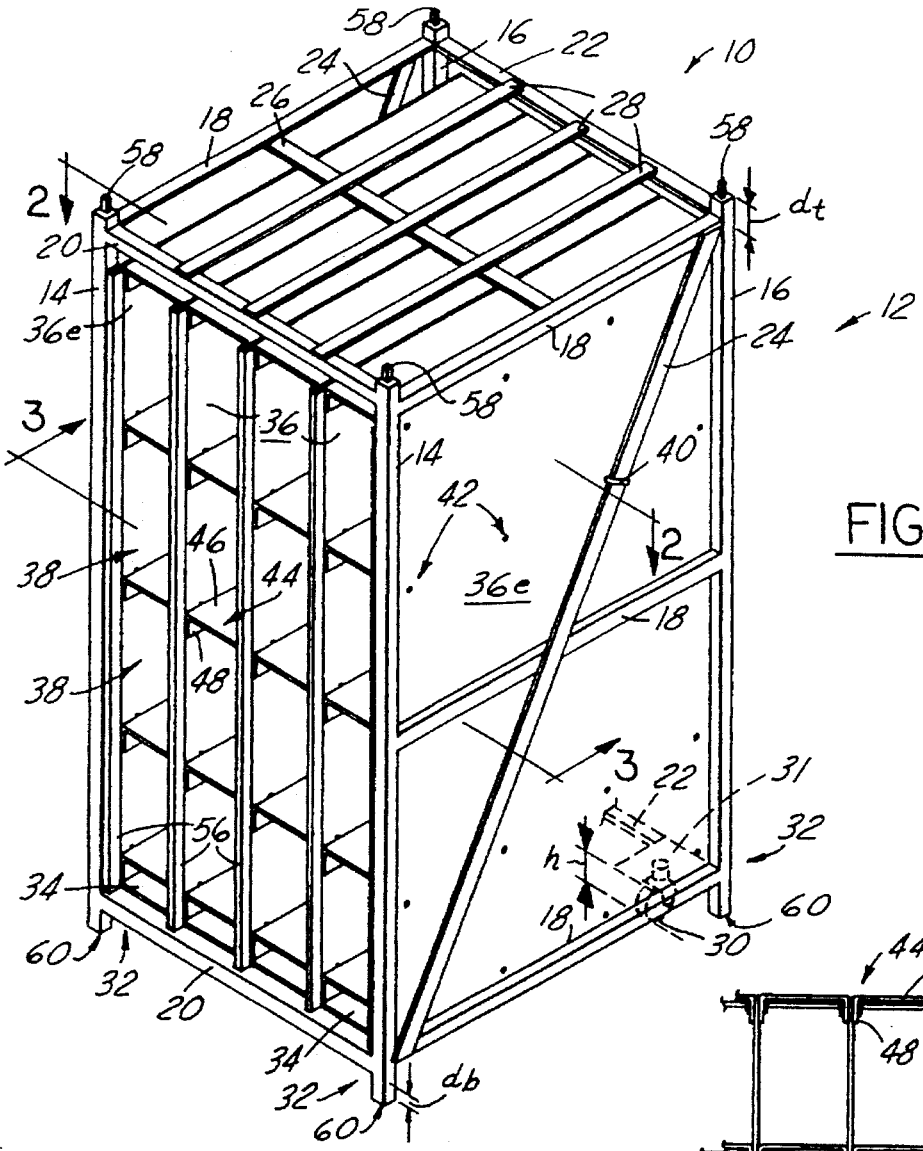
FIG. 1 is a perspective view of a stackable partitioned shipping container in accordance with the present invention.
Figure 2:
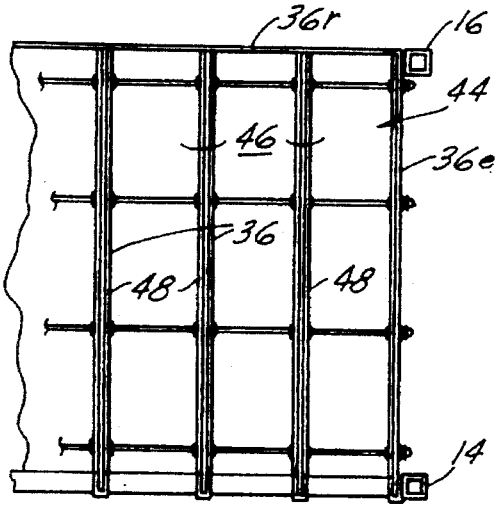
FIG. 2 is a partial sectional view of the stackable partitioned shipping container in accordance with the present invention taken along line 2—2 of FIG. 1, but without the shelving assembled thereon.
Figure 3:
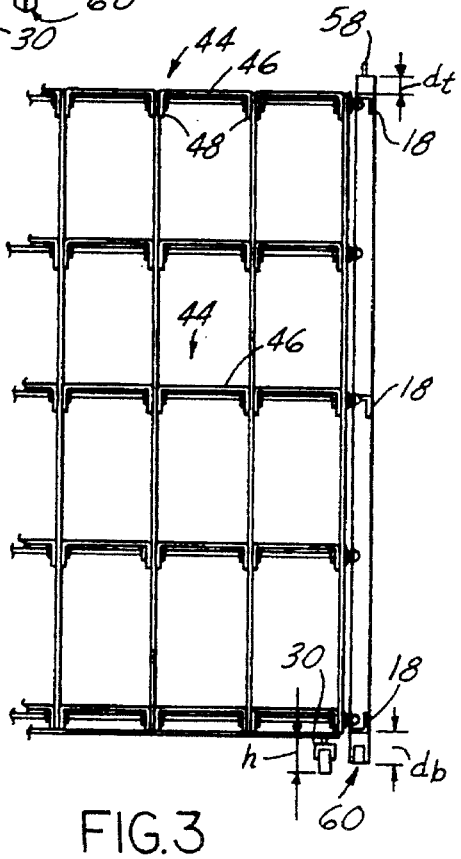
FIG. 3 is a partial sectional view taken along line 3—3 of FIG. 1, with the shelving situated thereon.

With reference to all of the FIGS., there is seen a stackable partitioned shipping container 10 in accordance with the present invention. The stackable partitioned shipping container 10 has a structural frame 12 made from metal, wood or plastic comprising front posts 14, rear posts 16, runners 18, front stringers 20, rear stringers 22, cross bracing 24, a slat stringer 26, and slats 28. Wheels 30 (only one being shown in FIG. 1 and being shown as hidden) support the structural frame 12 above the floor. The wheels 30 are preferably casters welded to a plate 31 at each corner 32 of the frame 12 at the floor 34 of the frame 12. All of the parts of the frame 12 are welded or otherwise connected together. The floor 34 of the frame 12 is a panel of generally of the same type as panel partitions 36 that separate the stackable partitioned shipping container 10 into columns of compartments 38.

The panel partitions 36 that separate the columns of compartments 38 include end panel partitions **36*e* and a rear panel partition 36*r*. All of the panel partitions 36, 36*e*, 36*r* are plastic sheets, preferably polyvinyl chloride. After the floor 34 is laid in the frame 12, and the rear panel partition 36*r* placed in the frame 12 against the rear posts 16 and cross bracing 24 at the rear of the frame 12 12 (not shown), the panel partitions 36 are placed within the frame starting with an end panel partition 36*e* at a first side and the remaining panel partitions 36, 36*e* are positioned one at a time toward an opposite second side. The end panel partition 36*e* is anchored to a front post 14 and a rear post 16 on one side of the frame 12 by suitable fastening means such as rivets or screws with or without nuts. Alternatively, each end panel partition 36*e* may be tied to a front post 14 and rear post 16 with wire or cables 40 strung through holes 42 through the end panel partition 36*e*. The other panel partitions 36 are positioned and held in place by channel shelves 44 which are positioned within the frame 12** on a column by column basis as will now be explained.

Figure 4:
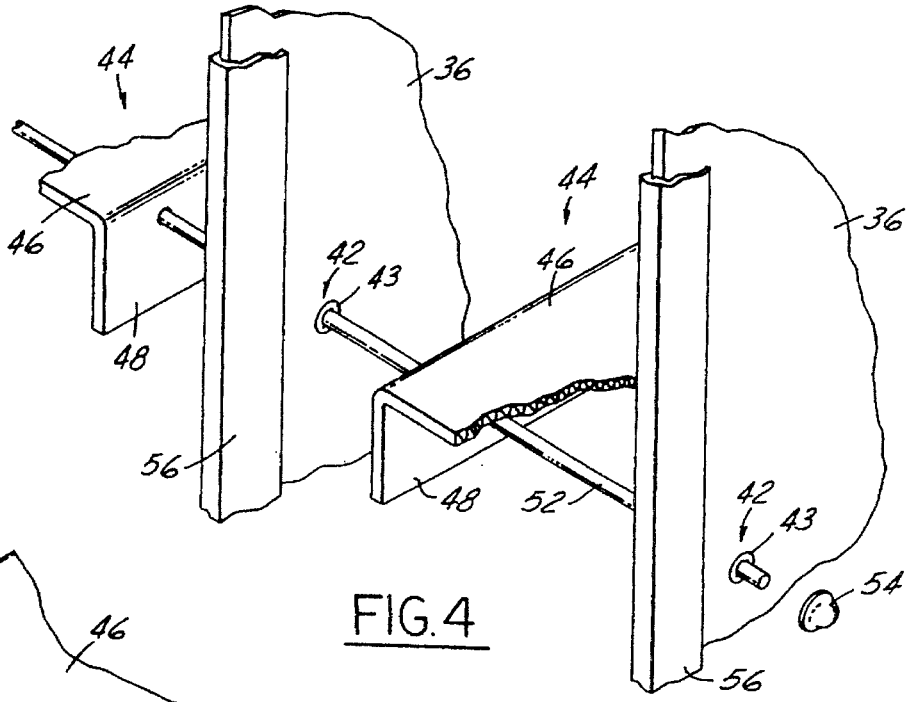
FIG. 4 is a partial perspective detail showing how the reinforced shelving is assembled.
Figure 6:
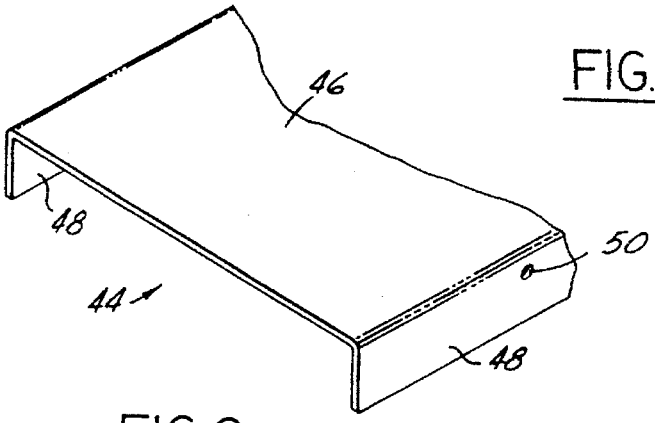
FIG. 6 is a partial perspective detail view of the first embodiment of a shelf of the present invention.
Figure 5:
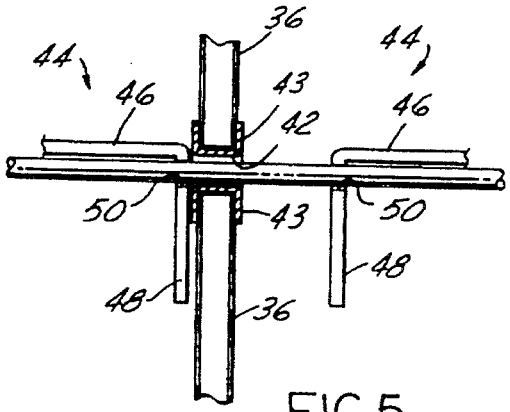
FIG. 5 is a partial elevational detail showing how the reinforced shelving is assembled with a first embodiment of the shelves.

Each panel partition 36 has a multiplicity of determinately spaced holes 42. Holes 42 are preferably grommeted with eyelets 43, as shown in FIG. 4. Each channel shelf 44 has a shelf plane 46 flanked by channel legs 48. The channel legs are provided with holes 50 spaced determinately along the channel legs 48, at generally the spacing from front to rear of the spaced holes 42 in the panel partitions 36. As a channel shelf 44, which for purposes of reference we shall call a "first channel shelf 44," is placed into position beside a standing panel partition 36, which for reference we shall call a "first panel partition 36," the holes 50 of the first channel shelf 44 are roughly aligned with the spaced holes 42 of the first panel partition 36. A rod 52 is strung through a hole 42 of the first panel partition 36 and the aligned holes 50 of the two channel legs 48 of the first channel shelf 44. Each remaining set of aligned holes 50 of the channel legs 48 adjacent the panel partition 36 is also strung with a rod 52 which is first strung through an aligned hole 42 of the first panel partition 36. Each channel shelf 44 necessary to complete a column of channel shelves 44 above or below the first channel shelf 44 are spaced one above or below another, each having its holes 50 strung with rods 52 extending through the first panel partition 36. Thereafter, a "second " panel partition 36 is placed on the floor 34 of the structural frame 12 with its holes 50 aligned with the rods 52 extending from the channel legs 48 of the channel shelves 44 in the column with the first channel shelf 44. This is repeated with a "third" and "fourth" panel partitions 36 until all of the panel partitions 36 and channel shelf 44 are in place. Preferably, an end panel partition **36*e* is last placed on the frame 12, which is fastened to the frame 12 in the manner discussed for the first end panel partition 36*e*. Protruding from the last end panel are ends of the rods, each of which is capped with a cap 54. A like cap 54 is on the end of each rod protruding from the first end panel partition 36. An end channel 56 is used to dress the front edge of each panel partitions 36**.

Referring in particular to FIG. 1, an insert 58 is seen at the top of each front post 14 and rear post 16. Each insert 58 may be received in a hollow 60 of a front post 14 or rear post 16 when one stackable partitioned shipping container 10 is stacked upon another stackable partitioned shipping container 10. In the preferred embodiment, the front posts 14 and rear posts 16 are hollow, square tubular sections. The insert 58 is formed on a plate welded to the top of the post 14, 15.

The sum of the lengths "$d_t$" of the top of the front post 14 or rear post 16 (from an end of the post 14, 16 to the front stringer 20 or rear stringer 22 most proximate to the end of the post 14, 16) and the length "$d_b$" of the bottom of the front post 14 or rear post 16 (from an end of the post 14, 16 to the front stringer 20 or rear stringer 22 most proximate to the end of the post 14, 16) is greater than the diametric length "h" from the periphery of each wheel 30 to the plate 31 on which the wheel 30 is mounted. In other words, $d_t+d_b>h$. Accordingly, when one stackable partitioned shipping container 10 is stacked upon another stackable partitioned shipping container 10, the wheels 30 are suspended or "nested" between stackable partitioned shipping containers 10, so that they do not bear upon the stackable partitioned shipping container 10 below them.

Figure 7:
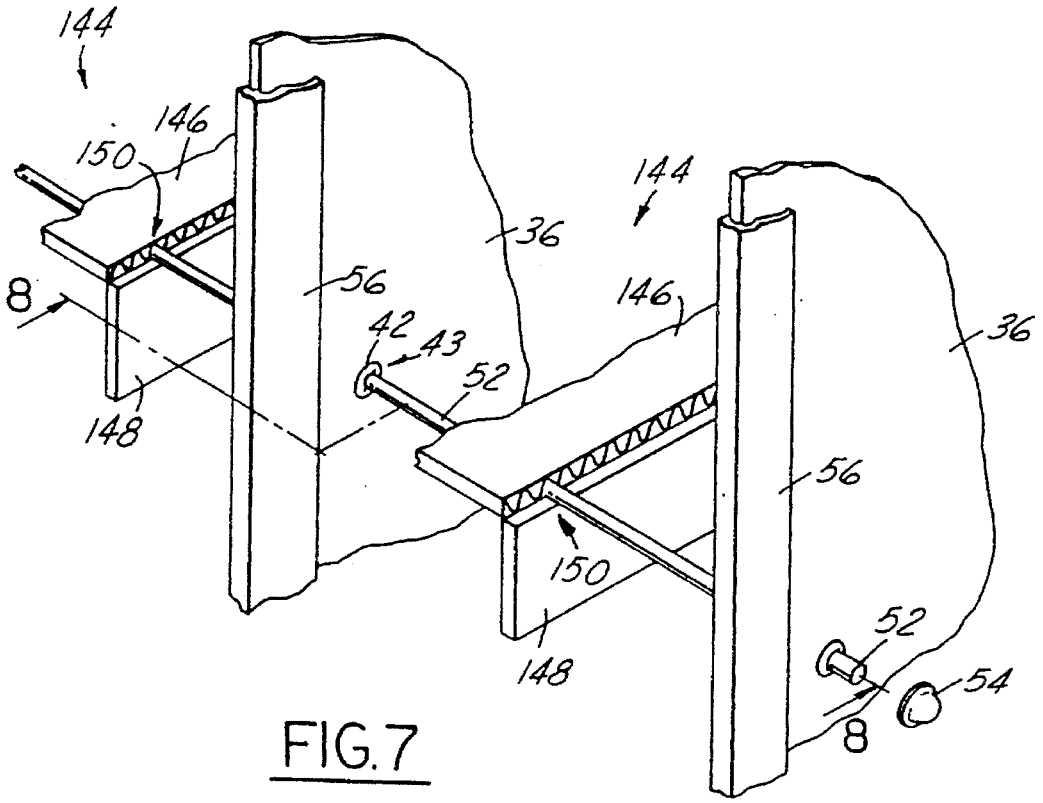
FIG. 7 is a partial perspective detail showing how the reinforced shelving is assembled as another embodiment of the present invention.
Figure 8:
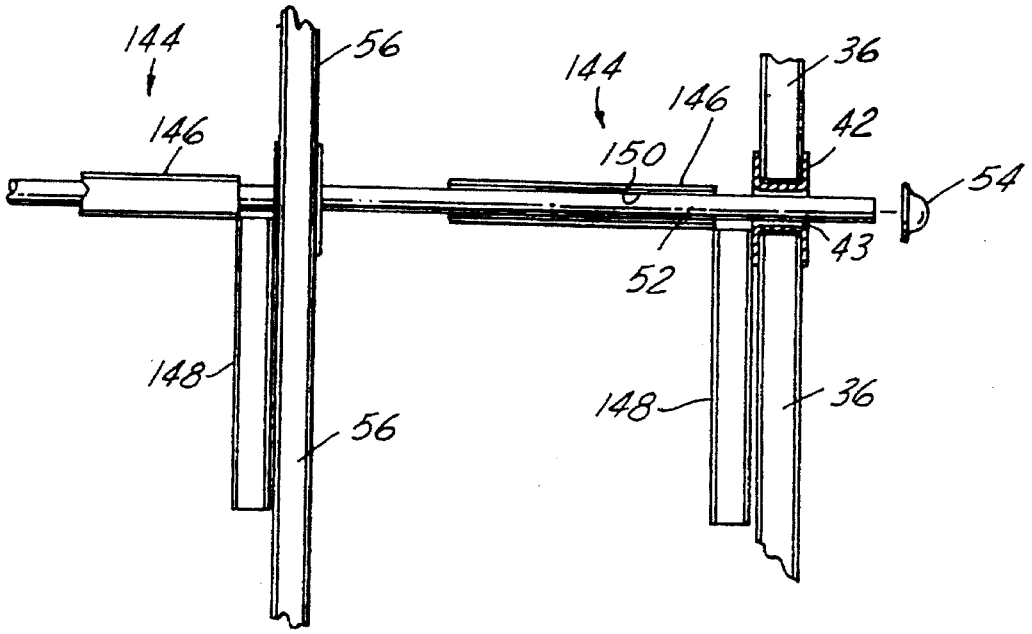
FIG. 8 is a partial cross section taken along line 8—8 of FIGS. 7.

Finally, reference is made to FIGS. 7 and 8 showing another embodiment of the channel shelves 144 of the present invention. In accordance with the embodiment, the shelves are made of a corrugated or crated material, such as corrugated board or plastic. Because of the corrugations, passageways 150 extend within the thickness of the shelf plane 146, across the shelf plane 46 from proximate to one channel legs 148 to another. It is through these passageways 150 that the rods 52 may be strung in the manner that the rods 52 are strung through the holes 150 of the first embodiment.

The frame 12 may be made from various structural elements made from metal, plastic or wood.

Figure 9:
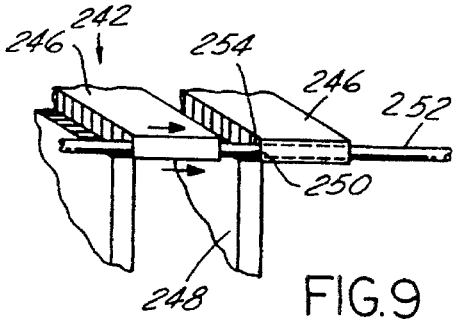
FIG. 9 is a fragmentary perspective view showing another embodiment of the shipping container without using wall panels.

The embodiment of FIG. 9 shows a container or structure with a plurality of channel shelves 242 made from a corrugated material such as made from board or plastic. Each shelf 242, with the corrugations defining passageways, has the adjacent shelf plane 246 designed and arranged to rest on the abutment 250 of the adjacent shelf vertical leg 248. Each rod 252 is strung through the aligned corrugated passageways or holes 254 of the adjacent shelves 242. Each rod protrudes through the end shelves and are provided with retaining caps, not shown.

Figure 10:
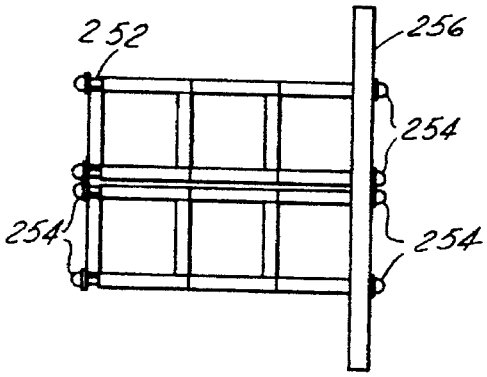
FIG. 10 is a top plan view illustrating another embodiment of the shipping container using only one wall panel.

In FIG. 10, the shelves are generally arranged as described for FIG. 9, with the rods 252 extending through the aligned corrugated passageways or holes. Retaining caps 254 are applied to the ends of rods at one side of the structure, while the rods 254 extending through the passageways at the opposite side of the structure extend through corresponding openings provided in a wall panel 256. The retaining caps are placed on the rods 252 exteriorly of the panel 256 as shown in FIG. 10.

It should be understood that a stackable partitioned shipping container 10 in accordance with the present invention has been described in detail, but may be subjected to modifications in other embodiments incorporating inventive features. Accordingly, it is intended that the foregoing disclosure is to be considered as illustrating the principals of the present invention as an example of those features and not as a delimiting description, which is the purpose of the claims that follow:

We claim:

1. A stackable partitioned shipping container comprising:

a frame defining a right side frame structure, left side frame structure, a bottom frame structure, a front side frame structure and a back side frame structure;

a plurality of panel partitions aligned generally parallel to one another and spaced one from another from said right side frame structure to said left side frame structure, said panel partitions being supported by said bottom frame structure and each of said panel partitions having panel holes arranged through said each panel partition;

a plurality of rods strung through said panel holes; and a plurality of shelves separating said partitions, each shelf having a shelf plane, said shelves supported on said rods strung through said partitions.

2. The stackable partitioned shipping container of claim 1, wherein each said shelf is shaped as a channel having a pair of channel legs, said channel shelf being arranged between said channel legs, each channel leg having a plurality of channel holes arranged therethrough, said rods being strung through said channel holes.

3. The stackable partitioned shipping container of claim 1, wherein said panel partitions are plastic sheets and wherein the frame has a floor supported by said bottom frame structure, said floor comprising a plastic sheet laid upon said bottom frame structure and said panel partitions arranged above said floor.

4. The stackable partitioned shipping container of claim 3, further comprising wheels attached to said bottom frame structure for rolling said stackable partitioned shipping container about, said wheels supporting said stackable partitioned shipping container when said frame is not stacked on another stackable partitioned shipping container.

5. The stackable partitioned shipping container of claim 3, wherein said stackable partitioned shipping container has a plurality of compartments formed between said shelves and said panel partitions.

6. The stackable partitioned shipping container of claim 5, wherein an end panel partition is attached to said left side frame structure and an end panel partition is attached to said right side frame structure and wherein each rod of the plurality of rods extends from said end panel attached to said right side frame structure to said end panel attached to said left side frame structure, said each rod having retaining means disposed at said end panel partitions for retaining said each rod within said plurality of panel partitions.

7. The stackable partitioned shipping container of claim 4, wherein said stackable partitioned shipping container is a first stackable partitioned shipping container and wherein said frame has four corner posts defining a box shape of said frame, each post having an insert disposed at the top of said each post and each post having a hollow at the bottom of each post for receiving an insert from a second stackable partitioned shipping container when the first stackable partitioned shipping container is stacked upon said second stackable partitioned shipping container, said wheels being nested between said stackable partitioned shipping containers without resting upon said second stackable partitioned shipping container.

8. A method of assemblying a stackable partitioned shipping container that has a frame defining a right side frame structure, left side frame structure, a bottom frame structure, a front side frame structure and a back side frame structure, that has a plurality of panel partitions, each of said panel partitions having panel holes arranged through said each panel partition, that has a plurality of rods, and that has a plurality of channel shelves separating said partitions, each shelf having a shelf plane, each said shelf being shaped as a channel having a pair of channel legs, said channel shelf being arranged between said channel legs, each channel leg having a plurality of channel holes arranged therethrough, the method comprising the steps of:

a first step of placing a first panel partition against one of said right side frame structure and left side frame structure;

a second step of placing one of said plurality of channel shelves into a position beside said first panel partition;

a third step of aligning the holes of said channel shelf with the spaced holes of the first panel partition;

a forth step of stringing one of said plurality of rods through a hole of said panel partition and the aligned holes of the two channel legs of said channel shelf;

a fifth step of stringing others of said plurality of rods through each of the remaining sets of aligned holes of the channel legs adjacent said panel partition after first stringing said others of said plurality of rods through holes of the panel partition aligned with the remaining sets of aligned holes of the channel legs adjacent said panel partition;

a sixth step of repeating said second through said fifth steps for each channel shelf necessary to complete a column of channel shelves above or below the first said channel shelf;

a seventh step of placing another panel partition against said channel shelves in the column of channel shelves completed in the sixth step;

an eighth step of placing one of said plurality of channel shelves into a position beside said another panel partition;

a ninth step of repeating said third through said eighth steps until said another panel partition is against the other of said right side frame structure and left side frame structure;

stringing said rods through the holes of the last said another panel partition; and capping the ends of said rods to retain said rods in said stackable partitioned shipping container.

* * * * *